US012460901B2

(12) United States Patent
Howley

(10) Patent No.: US 12,460,901 B2
(45) Date of Patent: Nov. 4, 2025

(54) HAND-OPERATED SELF DEFENSE DEVICE

(71) Applicant: Anthony Adrian Howley, Mariastein (CH)

(72) Inventor: Anthony Adrian Howley, Mariastein (CH)

( * ) Notice: Subject to any disclaimer, the term of this patent is extended or adjusted under 35 U.S.C. 154(b) by 273 days.

(21) Appl. No.: 18/106,361

(22) Filed: Feb. 6, 2023

(65) Prior Publication Data

US 2023/0251057 A1 Aug. 10, 2023

(30) Foreign Application Priority Data

Feb. 8, 2022 (CH) ..... 000111/2022

(51) Int. Cl.
*F41B 13/00* (2006.01)
*F41H 9/10* (2006.01)

(52) U.S. Cl.
CPC ..... *F41B 13/00* (2013.01); *F41H 9/10* (2013.01)

(58) Field of Classification Search
CPC . F41B 13/00; F41B 15/08; F41H 9/10; A41D 13/082; A44C 5/0007
USPC ..... 463/47.2
See application file for complete search history.

(56) References Cited

U.S. PATENT DOCUMENTS

| | | | | |
|---|---|---|---|---|
| 1,333,792 | A | 3/1920 | Bunnell | |
| 4,615,078 | A | 10/1986 | Teich | |
| 5,538,164 | A * | 7/1996 | Rivas | F41H 9/10 222/153.04 |
| 6,244,639 | B1 | 6/2001 | Storck | |
| 2012/0005796 | A1 * | 1/2012 | Mauk | A41D 13/084 2/16 |
| 2013/0123024 | A1 * | 5/2013 | Harris | F41B 15/02 463/47.2 |
| 2020/0248982 | A1 | 8/2020 | Trussell | |

FOREIGN PATENT DOCUMENTS

WO 2021024228 A1 2/2021

OTHER PUBLICATIONS

GE Search Report issued for Switzerland Application No. CH 000111/2022 on May 11, 2022, 1 page.

* cited by examiner

*Primary Examiner* — Michael C Grant
(74) *Attorney, Agent, or Firm* — Hard IP LLC

(57) ABSTRACT

A hand-operated self-defense device includes a first strap element for attachment to a palm, a second strap element for attachment to a wrist, a connecting element for connecting the first strap element to the second strap element, and a defense element connected to the connecting element or the first strap element. The defense element includes a support plate element including a plurality of tip element arranged on the support plate element so as to span a surface.

8 Claims, 8 Drawing Sheets

HAND-OPERATED SELF DEFENSE DEVICE

CROSS-REFERENCE TO RELATED APPLICATIONS

This application claims the benefit of Swiss patent application no. CH 000111/2022, filed Feb. 8, 2022, the contents of which is incorporated herein by reference in its entirety.

TECHNICAL FIELD

The present invention relates to a manual, that means, a hand-operated, self-defense device.

DESCRIPTION OF RELATED ART

Document US 2012/005796 shows a glove-like hand protector which comprises a cover consisting of a flexible textile containing an insert, which at least partially covers the back of the hand and the palm. The insert comprises a pad resting on the back or palm of the hand made of a soft, pliable material, for example foam, and a rigid bar-like element made of a metallic material, for example aluminium, titanium, carbon fiber or impact-resistant PVC. The insert is received in a slot in the cover, with the rigid bar-like element overhanging the slot.

By means of the glove-like hand protector, an assault by an attacking person can also be fended off by a weaker person, since the attacking person feels surprisingly strong pain even in the case of a light defensive blow and the attacked person can use this moment of surprise to flee. However, the fact that an attack and a corresponding defensive reaction have occurred cannot necessarily be proven beyond doubt at a later point in time. Due to the elongated, rounded shape of the beam-like element, unspecific bruises may form on the surface of the attacked person's skin at best, which cannot be clearly assigned to an attack or defense situation but may also result from other impacts to which the affected part of the attacked person's body may have been exposed before or after the attack.

A further disadvantage can be seen as a restriction in the mobility of the fingers of the hand associated with glove-like devices. From U.S. Pat. No. 1,333,792 A, a protective device and gripping device is known which is not designed as a glove. However, this previously known protective device and gripping device should be intended for use with a glove, since it is used to facilitate the handling of logs, pieces of ice and the like. To protect against injury and/or cold, this device is worn with a glove. Therefore, the beam-shaped platen member, which carries a plurality of tip members arranged in a row, is at the level of the finger part of the hand. There is no individual mobility of the fingers when wearing this protective and gripping device. An improved protection and gripping device is shown in U.S. Pat. No. 6,244,639 B1. This protection and gripping device is used to find improved grip on an ice surface. This protection and gripping device includes a rectangular pad member secured to the palm of the hand by strap members and having spike members long enough to penetrate an ice surface. For this application, it is advantageous if the tip elements are in the area of the ball of the hand or the edge of the hand, so that this protective and gripping device can still be used in the event of a fall. On the other hand, this protective and gripping device is not suitable for use as a self-defense device, since the position for optimal transmission of an impact force is not optimally selected.

Document WO2021/024228 A1 describes a glove which is equipped with the most diverse means of defense for defense in the most diverse situations, and also contains means for documenting an attack (camera) as well as for preserving evidence, i.e., by securing tissue cells, for example skin cells, parts of hair, blood or other body fluids of an attacker. However, the actual impact elements are located on the outside of the fingers, i.e., they are used when the attacked person defends himself/herself with punches. However, if the person wanted to fight off an attacker to avoid danger, he/she would reflexively turn their palms against the attacker, so this device is not optimal for an attacked person who intends to defend by pushing the attacker away.

However, it has also turned out to be a disadvantage that the operation of this glove can require a recurring training effort due to the many different options in practice to be able to correctly use the optimal means of defense within the shortest possible time in an emergency and to effectively repel the attack.

It is an object of the invention to develop a hand-operated self-defense device by means of which simple, intuitive self-defense is made possible without any training effort, while at the same time providing a deterrent by incorporating an integrated evidence storage device.

SUMMARY OF THE INVENTION

When the term "for example" is used in the following description, this term refers to examples of embodiments and/or variants, which is not necessarily to be understood as a more preferred application of the teaching of the invention. Similarly, the terms "preferably", "preferred" are to be understood as referring to an example from a set of embodiments and/or variants, which is not necessarily to be understood as a preferred application of the teaching of the invention. Accordingly, the terms "for example", "preferably", or "preferred" may refer to a plurality of embodiments and/or variants.

The following detailed description contains various embodiments of the hand-operated self-defense device. The description of a particular hand-operated self-defense device is to be considered exemplary only. In the description and claims, the terms "include", "comprise", "feature" are interpreted as "including, but not limited to".

According to the invention, the hand-operated self-defense device includes a first strap element for attachment to a palm of a hand, a second strap element for attachment to a wrist of the hand, a connecting element for connecting the first strap element to the second strap element, and a defense element connected to the connecting element or the first strap element. The defense element includes a support plate element including a plurality of tip elements disposed on the support plate element so as to span a surface. The support plate element is arranged on the connecting element in such a way that it is configured to rest on a palm of the hand. In particular, the support plate element can have a circular or oval surface. When the support plate element has a circular or oval surface, it rests on the palm of the hand without being felt as a hindrance. In particular, the fingers remain free, so that the mobility of the hand is at most slightly restricted.

The tip elements are configured in such a way that they project beyond the support plate element, i.e., protrude from the support plate element. The tip elements are directed away from the hand surface, i.e., they are located on the side of the support plate element opposite the hand surface.

The tip elements can, for example, be configured as conical or pyramid-shaped tip elements. In particular, the tip elements can be configured as spike-shaped tip elements.

According to an embodiment, the tip elements are arranged in an annular configuration on the support plate element. According to an embodiment, the tip elements are distributed on the surface of the support plate element according to a pattern. According to an embodiment, the tip elements are randomly distributed on the surface of the support plate element.

According to an embodiment, at least one of the tip elements includes an opening.

In particular, the defense element can be configured to rest on the palm of a hand; according to an embodiment not shown, it can also be configured to rest on the back of a hand.

According to an embodiment, the defense element includes an evidence collection device. In particular, evidence collection device can include an adhesive. The adhesive means may include an adhesive. The evidence collection device can be configured as an adhesive surface, that is, a surface containing an adhesive. By means of the adhesive, possible evidence, for example tissue cells, skin scales, blood, hair of the attacker are fixed on the evidence collection device, so that a later identification of the attacker is possible, for example by means of DNA analysis. According to an embodiment, the defense element comprises a rough surface. For example, the surface roughness can be increased by a plurality of grooves on the surface. According to an example, the grooves are configured as channels, in particular zigzag-shaped channels. By means of the rough surface, in particular the grooves or channels, evidence can stick particularly well to the defense device.

According to an embodiment, the evidence collection device can be formed by at least one of the tip elements or may be mounted on a tip element. For example, at least one of the tips of the tip element can be provided with a cavity in which evidence can be received. Alternatively or additionally, at least one of the tip elements can be provided with an adhesive.

According to an embodiment, the tip elements include a metal, for example, aluminium, titanium, iron, glass, plastic, or a composite material, for example, a plastic containing glass fibers or carbon fibers. According to an embodiment, at least the tip elements can contain polymethyl methacrylate (PMMA). In particular, the support plate element can contain PMMA. Particularly preferably, the tip elements and the support plate element can consist of PMMA.

According to an embodiment, the tip elements can be covered with a cover. The cover can be removed at any time in the simplest way without expenditure of time or can fall off immediately in the event of a shock or impact, so that the manually operated self-defense device can be used at any time without delay.

At least one of the first and second strap elements can include a flexible material configured to conform to the shape of the wearer's hand. For example, at least one of the first and second strap elements can include a textile material or can consist of a textile material.

According to an embodiment, at least one of the first and second strap elements includes a stretchable material. In particular, at least one of the first or second band elements can contain an elastomer.

According to an embodiment, an overall length of at least one of the first or second band elements can be adjusted, i.e., it can be adapted to the size of the hand. In particular, at least one of the first or second band elements can contain a plurality of hole elements or recesses that can be selected depending on the size of the hand.

According to an embodiment, the second strap element includes a closure mechanism to secure the self-defense device to the wrist. According to an embodiment, the first strap element includes a closure mechanism to secure the self-defense device to the palm of the hand. In particular, the hole elements or recesses can be configured for engaging an engagement element of the corresponding closure mechanism, so that a single hand-operated self-defense device can be used for all hand sizes.

The closure mechanism can comprise an element selected from the group consisting of a buckle, a hook and loop fastener, or a zipper.

According to an embodiment, the support plate element contains at least one warning element. The warning element can contain a warning signal element from the group consisting of optical or acoustic warning elements.

According to an embodiment, the support plate element includes at least one pressure vessel for containing a fluid. According to an embodiment, the fluid contained in the pressure vessel includes an identification means or a defense means. For example, the fluid may include a fluid that is used to defend against an attack or may be used for identification. For example, the fluid may include a dye. For example, the fluid can comprise a liquid that causes irritation to the skin. In particular, the pressure vessel may include a fluid by means of which irritation of the skin may be triggered.

According to an embodiment, the pressure vessel contains a metering device and an actuator, wherein the metering device can be activated by means of the actuator in such a way that the fluid can exit the pressure vessel. The actuator can be activated manually simply by finger pressure on a grip element. By means of the grip element, a channel portion including an actuator fluid channel can be opened to provide the fluid. According to an embodiment, a constriction of the metering device is opened by a pressure force applied to the channel portion so that the pressurized fluid in the pressure vessel can exit the pressure vessel abruptly. In particular, the fluid passes outwardly through the actuator fluid channel into an opening disposed in the cover element of the actuator. The opening can in particular contain a nozzle so that the fluid can leave the support plate element at high speed.

An essential advantage of the hand-operated self-defense device according to the invention is to be seen in the fact that it is simply constructed and therefore its function is immediately recognizable. The wearer of the hand-operated self-defense device according to the invention can thus already create a deterrent effect by carrying the hand-operated self-defense device on him or her. Advantageously, the hand-operated self-defense device can be manufactured in eye-catching colors or provided with a coating or paint in eye-catching colors that have a signal effect and thus trigger a visual warning effect. The hand-operated self-defense device can also include luminous or luminescent signaling elements that can enhance the warning effect, particularly in poor lighting or darkness.

In addition, the hand-operated self-defense device can be used immediately. Unlike many known self-defense devices, it can be used immediately for a wide variety of threat scenarios. A large number of known self-defense devices are kept in pockets, so that in an emergency valuable time can pass before these known self-defense devices are ready for use. Since the self-defense device according to the invention is carried on the hand, such a delay is avoided.

Moreover, the functions of the hand-operated self-defense device are designed simply to avoid confusion, which can also lead to delayed reactions. The main objective is to confuse the attacking person and thwart his/her misguided ambitions. The self-defense device according to the invention can be used in different modes of operation, for example, to produce a pain impulse by means of tip elements, to deter by means of bright light or an acoustic warning signal, or to repel an attack by applying a fluid that irritates the skin or a dye that causes confusion. Each mode of operation has its own particular advantages.

The self-defense device according to the invention is equipped with an additional function of collecting evidence, for example DNA, which can be valuable for a later prosecution of an attacking person.

The tip elements offer an additional advantage in that they not only cause a strong pain reaction when piercing the skin, but also additionally leave a very distinctive mark conditioned by the skin injury, which enables easier and faster identification of an attacking person. Pepper spray has long been considered the best method of non-lethal self-defense, but is often not available at the right time. If a pepper spray container is integrated into the self-defense device, it can also be carried on the hand. This ensures its immediate availability in an emergency.

The self-defense device can emit an acoustic or optical warning signal in a further mode of operation. The acoustic warning signal in the form of an alarm, for example at a volume in the range of 125 to 140 decibel (dB), or the visual warning signal in the form of bright, glaring light may already encourage an attacking person to abandon his/her notion of an easy target. Together with a "spotlight" of 1000 lumens the attacking person can be confused, and others can be alerted nearby that someone needs help.

The use of a glass tip element can also support DNA collection.

A support plate element may be provided for each of the modes of operation. A support plate element capable of emitting audible or visual warning signals is particularly rechargeable. A support plate element that includes a pressurized container, thus a pressure vessel, for a fluid can in particular be rechargeable.

Each of the support plate elements can be attached to the defense element so that the hand-operated self-defense device is always available in the currently desired mode of operation.

BRIEF DESCRIPTION OF THE DRAWINGS

In the following, the hand-operated self-defense device is illustrated by some embodiments. It is shown in.

DETAILED DESCRIPTION

Figure 1A:
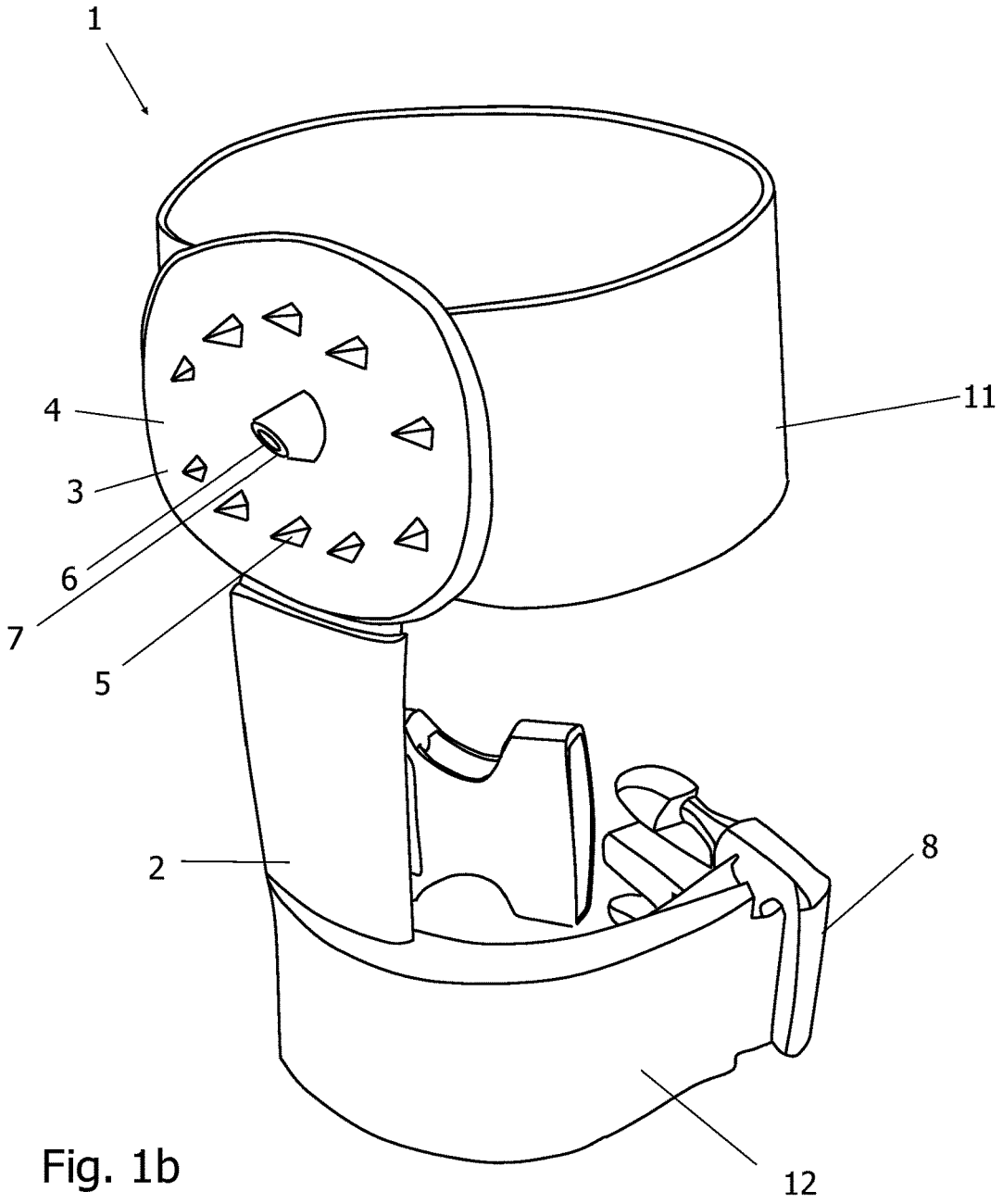
FIG. 1*a* a view of a hand-operated self-defense device according to a first embodiment of the invention, FIG. 1*b* a section through a tip element containing an evidence collection device according to FIG. 1*a*, FIG. 2 an example of use of the hand-operated self-defense device according to FIG. 1*a*, FIG. 3 a view of a hand-operated self-defense device according to a second embodiment of the invention, FIG. 4 a section through a tip element containing an evidence collection device according to a first variant, FIG. 5 a section through a tip element containing an evidence collection device according to a second variant, FIG. 6*a* a section through an evidence collection device according to a third variant in a first position, FIG. 6*b* the section through the evidence collection device according to FIG. 6*a* in a second position.
Figure 3:
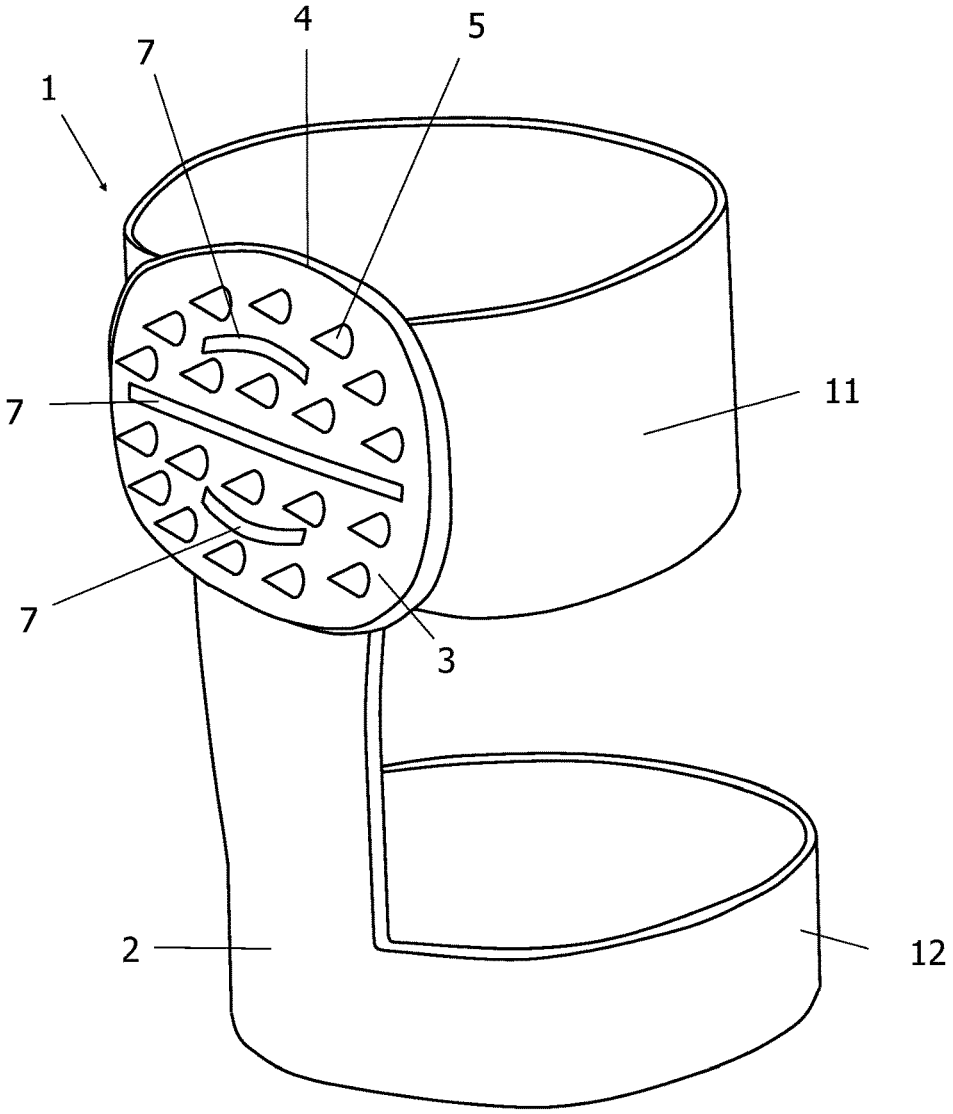

FIG. 1*a* shows a view of a hand-operated self-defense device 1 according to a first embodiment of the invention. The hand-operated self-defense device 1 includes a first strap element 11 for attachment to a palm of a hand, and a second strap element 12 for attachment to a wrist. Further, the hand-operated self-defense device 1 includes a connecting element 2 for connecting the first strap element 11 to the second strap element 12. A defense element 3 is connected to the connecting element 2 or the first strap element 11. The defense element 3 includes a support plate element 4, which includes a plurality of tip elements 5 arranged on the support plate element 4 so as to span a surface. According to the present embodiment, the tip elements 5 are arranged in an annular configuration on the support plate element 4. One of the tip elements 5, in FIG. 1*a* a tip element 5 located inside the annular arrangement, contains an opening 6. According to this embodiment, the tip elements 5 forming the annular configuration are formed as pyramids. They could also have a cone shape, as shown in FIG. 3. When the opening angle of the cone or pyramid approaches zero, a needle-like structure is formed. The tip elements can therefore also have a needle shape according to an embodiment not shown.

In particular, the defense element 3 can comprise an evidence collection device 7 for collecting evidence. According to the present embodiment, the opening 6 of the tip element located inside the annular configuration is formed as an evidence collection device 7.

Evidence, for example tissue cells, hair, body fluids and the like, may accumulate in the opening 6 and remain there after the attack has been repelled by contact with the skin and any injury to the skin of the attacking person that may have resulted from the contact. The tip element or elements 5 may also include an adhesive. By means of the adhesive, adherence of the evidence is enabled so that it remains available even after escape from attack. In particular, a glue may be used as the adhesive. In particular, the adhesive should be inert to solid body particles, such as tissue cells, hairs, or body fluids, so that no chemical reactions can occur with the solid body particles or the body fluids.

In particular, the first strap element 11 can include a flexible material that can conform to the shape of the wearer's hand. In particular, the second strap element 12 can include a flexible material that can conform to the shape of the wearer's wrist. For example, at least one of the first and second strap elements 11, 12 can include a textile material.

According to the present embodiment, the second strap element 12 includes a closure mechanism 8 for securing the self-defense device to the wrist. According to the present embodiment, the closure mechanism 8 is configured as a buckle.

Figure 1B:
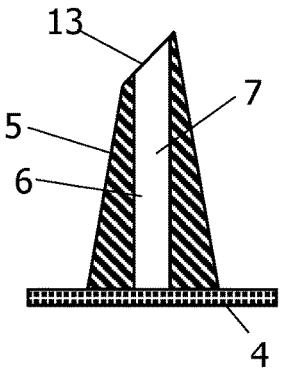

FIG. 1*b* shows a section through a tip element 5 containing an evidence collection device 7 according to FIG. 1*a*. The tip element 5 may be configured as a pyramid or a cone containing an opening 6. The tip of the tip element has been removed. According to a particularly advantageous embodiment, the cut surface does not run parallel to the base surface formed by the support plate element 4. Evidence can be received in the opening 6. According to the present embodiment, the opening runs concentrically with respect to the tip element 5, i.e., the center line of the opening 6 coincides with the center axis of the tip element 5. The opening 6 can extend to the support plate element 4 or, according to a variant not shown, can be configured as a blind hole which extends only over part of the total length of the tip element 5. When the tip element 5 is in contact with the skin surface, movement of the tip element 5 along the skin surface may allow evidence in the form of solid body particles, such as tissue cells, hairs, or body fluids to enter and remain in the opening 6. In particular, if the cut surface makes an angle with the base surface that is in the range of 30 degrees up to and including 75 degrees, loose tissue cells may also fall into the opening 6 so that evidence can still be collected even if the skin surface is briefly and lightly touched.

Figure 2:
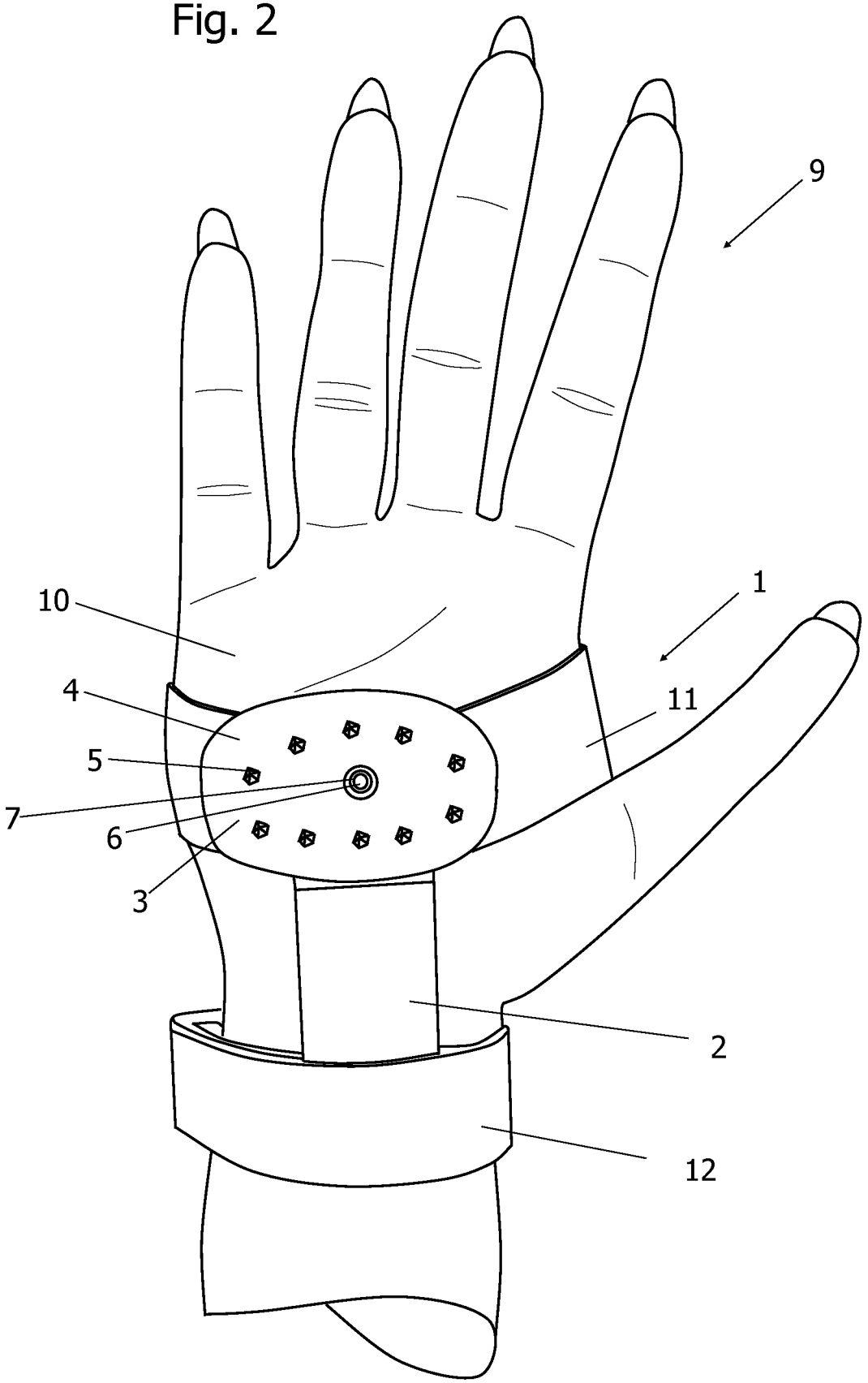

FIG. 2 shows an application example for the hand-operated self-defense device 1 according to FIG. 1*a*. According to this embodiment, the hand-operated self-defense device 1 is attached to a hand 9 in such a way that the defense element 3 comes to rest on the palm 10. The defense element 3 includes a support plate element 4 configured to rest on a palm 10. The present arrangement has the advantage that an optimum force transmission can be ensured, since according to the invention the impact force which can be transmitted by means of the palm 10 has proven to be greater in extensive tests than a force transmitted via the back of the hand or the edge of the hand. The force transmission can surprisingly be optimized by the arrangement of the defense element 3 in particular in a central area of the palm 10. Generally, the attacking person does not expect a large force transmission during such a defensive movement, if the defensive movement is triggered by means of the palm of the hand. Therefore, the attacked person can buy time for an appropriate reaction with a pushing movement due to the surprise effect achieved thereby. In particular, the attacked person has more time available for the possibility of escape or for making an emergency call. In addition, the evidence collection device 7 can be used to ensure that solid body particles, such as tissue cells, hair or body fluids of the attacking person remain on the evidence collection device 7 as a result of the pushing movement, often in conjunction with a scratching movement.

FIG. 3 shows a hand-operated self-defense device according to a second embodiment of the invention. The hand-operated self-defense device 1 includes a first strap element 11 for attachment to a palm of a hand, and a second strap element 12 for attachment to a wrist. Further, the hand-operated self-defense device 1 includes a connecting element 2 for connecting the first strap element 11 to the second strap element 12. A defense element 3 is connected to the connecting element 2 or the first strap element 11. The defense element 3 includes a support plate element 4, which includes a plurality of tip elements 5 arranged on the support plate element 4 so as to span a surface. According to the present embodiment, the tip elements 5 are configured in a multi-row arrangement on the support plate element 4.

In particular, the defense element 3 can comprise an evidence collection device 7 for collecting evidence. According to the present embodiment, the evidence collection device 7 is arranged between adjacent rows of tip elements 5. The evidence collection device 7 includes an adhesive. For example, an adhesive strip may be used. The adhesive can also be removable and/or replaceable. As described in connection with the preceding embodiment, the evidence collection device 7 can also be formed by at least one of the tip elements 5. The one or more tip elements 5 can also include an adhesive. Solid body particles, for example tissue cells, hairs or body fluids and the like, can accumulate on the evidence collection device 7 and remain there after the attack has been repelled by contact with the skin and a possible injury to the skin of the attacking person caused by the contact. By means of the adhesive, the adherence of evidence is made possible so that it remains available even after the person has fled from the attack. In particular, a glue can be used as the adhesive. In particular, the adhesive should be inert to solid body particles or body fluids so that no chemical reactions can occur with the solid body particles or body fluids.

In particular, the first strap element 11 can include a flexible material that can conform to the shape of the wearer's hand. In particular, the second strap element 12 can include a flexible material that can conform to the shape of the wearer's wrist. For example, at least one of the first and second strap elements 11, 12 can include a textile material.

According to the present embodiment, the second strap element 12 includes an elastic material by means of which the hand-operated self-defense device 1 can be fixed in the desired position.

Figure 4:
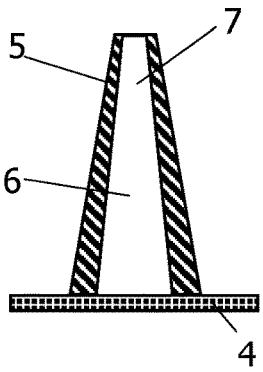

FIG. 4 shows a section through a tip element 5 containing an evidence collection device 7 according to a first variant. The tip element 5 may be configured as a pyramid or a cone, the tip of which has been removed to gain access to an opening 6. Evidence can be received in the opening 6. According to the present embodiment, the opening 6 is concentric with respect to the tip element 5, i.e., the centerline of the opening 6 coincides with the centerline of the tip element 5. The opening 6 can widen in cross-section from its mouth end to the opposite end resting on the support plate element 4, so that evidence received in the opening 6 remains in the opening 6.

Figure 5:
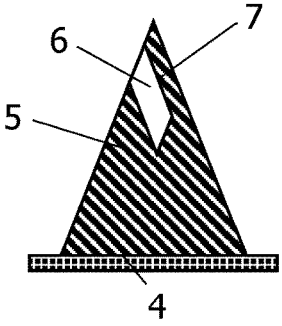

FIG. 5 shows a section through a tip element 5 containing an evidence collection device 7 according to a second variant. The evidence collection device 7 is again configured as an opening 6, which is located in the jacket area of the tip element 5, which in turn can be configured as a pyramid or cone. This variant has the advantage that the tip of the tip element 5 is retained. Thus, if a minor penetration of the skin of an attacking person occurs by means of the tip element 5, solid body particles, for example tissue cells, hairs, or body fluids, can collect in the opening 6, which can later serve as evidence.

Figure 6A:
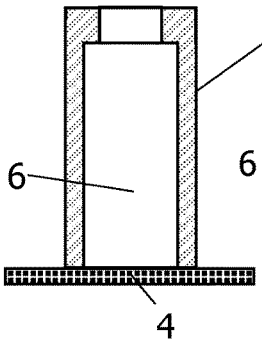
Figure 6B:
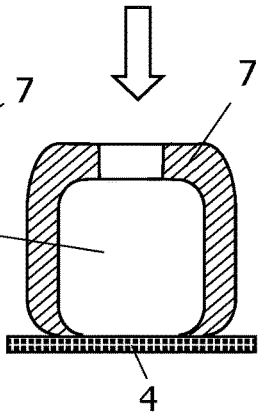

FIG. 6*a* shows a section through an evidence collection device 7 according to a third variant in a first position. This evidence collection device 7 is configured as a hollow body, for example a cylinder, with a concentric opening 6 widening in the direction of the support plate element 7. The hollow body contains an elastic material so that the hollow body undergoes a change in shape, for example is compressed, when a compressive force is applied, which is illustrated in FIG. 6*b*, which shows the section through the evidence collection device according to the variant illustrated in FIG. 6*a* in a second position. In the first position according to FIG. 6*a*, the evidence collection device 7 protrudes, for example, beyond the tips shown in one of FIG. 1*a* to FIG. 3. Therefore, when the evidence collection device 7 comes into contact with the body surface of an attacking person, it is compressed by the applied compressive force. This can result in a suction effect, whereby evidence for identifying the attacking person can enter the opening 6.

Alternatively or in addition thereto, the evidence collection device 7 may contain an adhesive, for example be coated with a glue. When a compressive force is applied, as shown in FIG. 6*b*, the surface of the evidence collection device 7 adheres to the body surface of the attacking person. As a result of the adhesive and/or a negative pressure created by the escape of air, solid body particles, for example tissue cells, hair, or body fluids, can thus be picked up as evidence on the surface of the evidence collection device 7 and in the opening 6.

It is also possible that the opening is partially filled with an adhesive, which only comes into contact with the body surface of the attacking person through the application of the compressive force. According to this variant, the evidence is received in the opening when a defensive blow is made with the hand-operated self-defense device, so that the required compressive force is built up by contact with the body surface of the attacking person and a compression of the evidence collection device occurs. After the compressive force is removed, the evidence collection device 7 is returned to its original shape, as shown in FIG. 6*a*. The evidence is located in the interior of the opening 6. If necessary, the opening 6 can still be closed later with a plug to protect the evidence from undesirable environmental influences.

Figure 7:
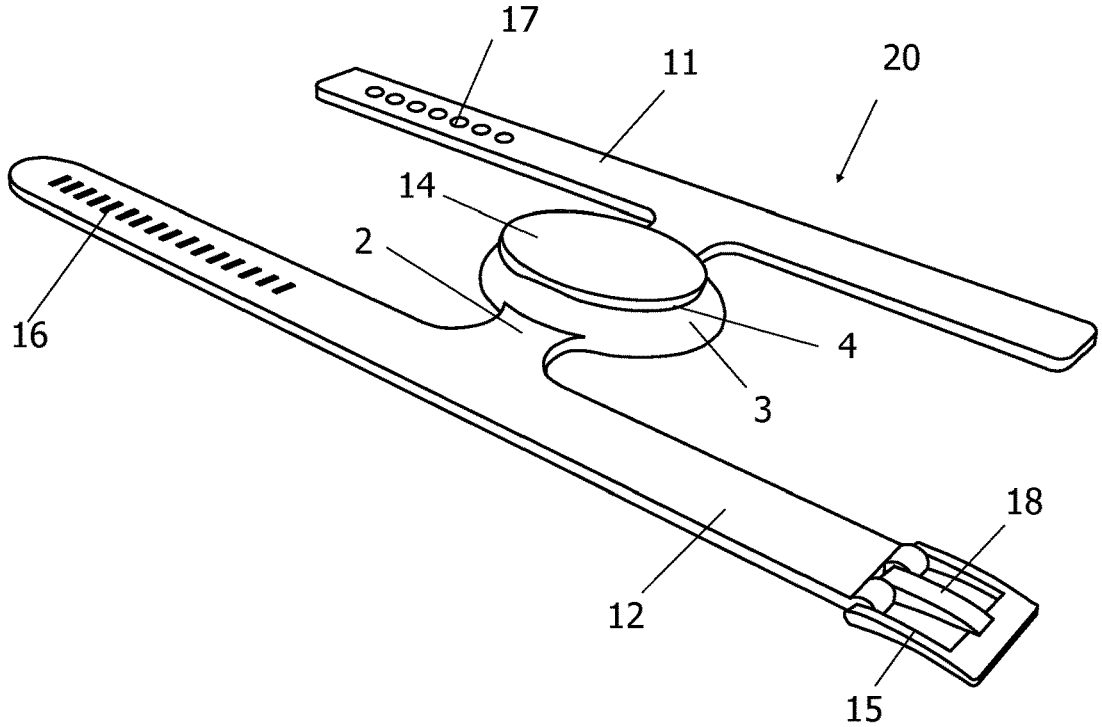
FIG. 7, a view of a hand-operated self-defense device according to a third embodiment of the invention, FIG. 8 a side view of the hand-operated self-defense device according to FIG. 7, FIG. 9 a top view of the hand-operated self-defense device according to FIG. 7, FIG. 10*a* a second variant of a support plate element, FIG. 10*b* a side view of FIG. 10*a*, FIG. 11*a* a third variant of a support plate element, FIG. 11*b* a side view of FIG. 11*a*

FIG. 7 shows a hand-operated self-defense device according to a third embodiment of the invention. The hand-operated self-defense device 20 includes a first strap element 11 for attachment to a palm of a hand, and a second strap element 12 for attachment to a wrist. Further, the hand-operated self-defense device 1 includes a connecting element 2 for connecting the first strap element 11 to the second strap element 12. A defense element 3 is connected to the connecting element 2. The defense element 3 includes a support plate element 4, which includes a plurality of tip elements arranged on the support plate element 4 so as to span a surface.

In FIG. 7, the tip elements are covered by a cover 14. As in the previous embodiments, the tip elements may form a multi-row arrangement on the support plate element 4. In particular, the defense element 3 may include an evidence collection device 7 for collecting evidence. On the evidence collection device 7, solid body particles, for example tissue cells, hairs or body fluids and the like, may accumulate and remain after the attack has been repelled by contact with the skin and any injury to the skin of the attacking person that may have occurred as a result of the contact. By means of an adhesive, the adherence of evidence can be enabled or enhanced so that it remains available even after escape from the attack. In particular, a glue can be used as the adhesive. In particular, the adhesive should be inert to solid body particles or body fluids so that no chemical reactions can occur with the solid body particles or body fluids.

In particular, the first strap element 11 may include a flexible material that can conform to the shape of the wearer's hand. In particular, the second strap element 12 can include a flexible material that can conform to the shape of the wearer's wrist. For example, at least one of the first and second strap elements 11, 12 can include a plastic material. In particular, at least one of the first or second strap elements 11, 12 can include an elastomer such that the hand-operated self-defense device 20 can be fixed in the desired position. According to the present embodiment, the second strap element 12 has a first end that includes a buckle 15. The second strap element 12 has a second end, which is adjoined by an end portion that includes a plurality of recesses 16. The recesses 16 serve to receive an engagement element 18 of the buckle 15. According to this embodiment, the hand-operated self-defense device 20 can be adapted to the wrist of the wearer and is thus designed to be adjustable.

Figure 8:
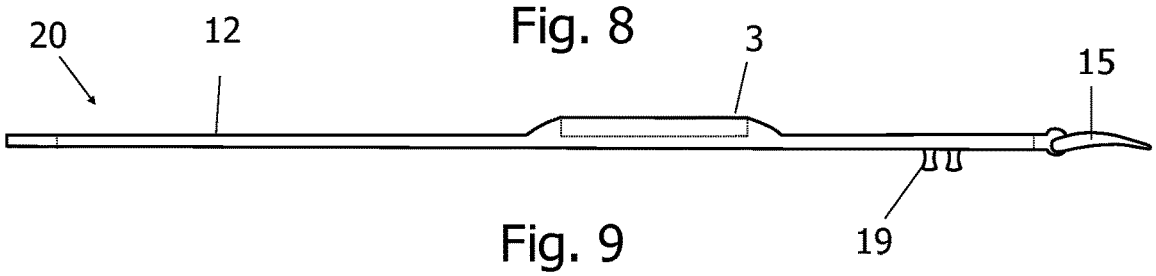

The first strap element 11 also includes a plurality of hole elements 17. The hole elements 17 serve to receive at least one corresponding pin element 19 (see FIG. 8), which is not visible in the present embodiment because it is arranged on the underside of the first strap element 11. In particular, the pin element or elements may have an oversize with respect to the hole elements 17 so that the pin element or elements are retained in the hole elements 17 when pressed into the hole elements. FIG. 8 shows a side view of the hand-operated self-defense device 20 according to FIG. 7. The side view shows the second strap element 12, its first end with the buckle 15, and its second end. The first strap element 11 is arranged behind the second strap element 12 in this illustration and is therefore not visible. Only the pin elements 19, which are intended to be received in the hole elements 17 shown in FIG. 7, are shown in this illustration.

Figure 9:
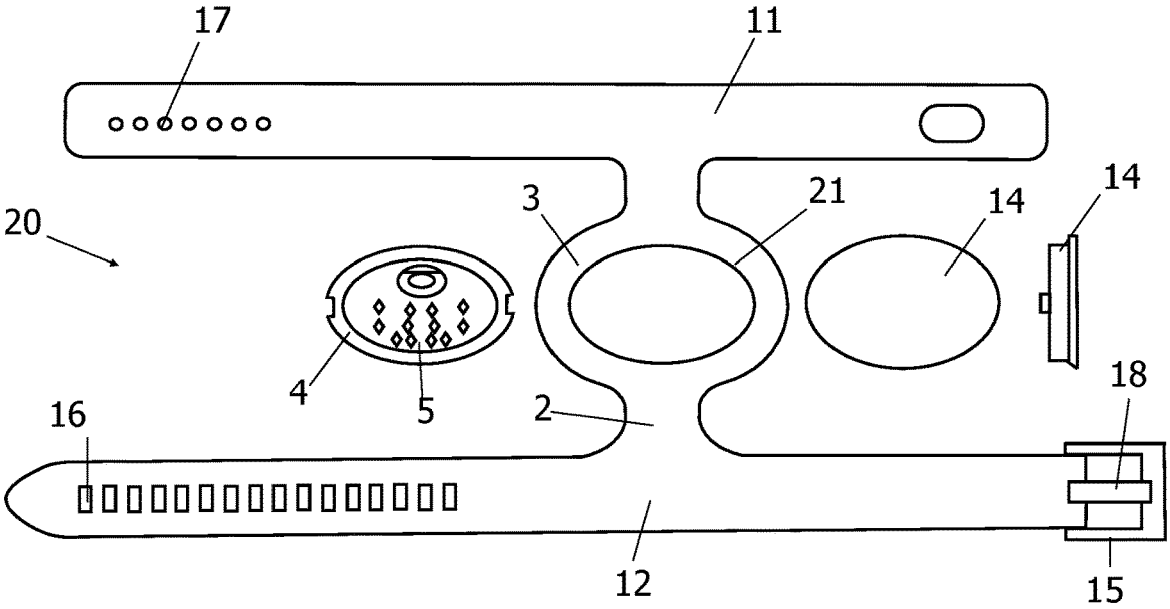

FIG. 9 shows a top view of the hand-operated self-defense device 20 according to FIG. 7. Identical or similarly acting components bear the same reference signs as in FIG. 7. The defense element 3 includes a support plate element 4, which includes a plurality of tip elements arranged on the support plate element 4 in such a way that they span a surface. According to the present embodiment, the support plate element 4 is configured to be removable. The defense element 3 includes a receiving element 21 configured to receive the support plate element 4. The support plate element 4, which contains the tip elements 5, can be covered by a cover 14, as shown in FIG. 7. According to this embodiment, the cover 14 is also configured to be removable. In FIG. 9, the cover 14 is shown both in a top view and in a side view.

Figure 10A:
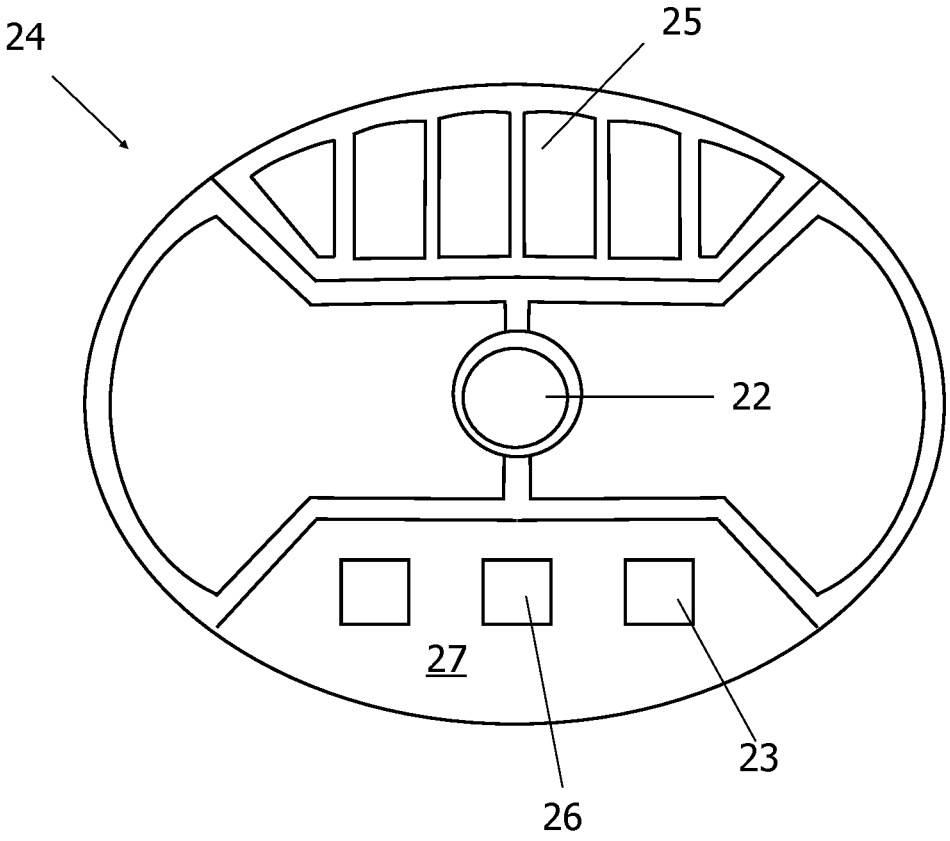

FIG. 10*a* shows a second variant of a support plate element 24, which includes at least one warning element. The support plate element 24 can be used instead of the support plate element 4. The support plate element can contain at least one warning element consisting of the group of acoustic warning elements 25 or optical warning elements 22, 23. The acoustic warning element 25 may comprise, for example, a horn element or bell element by means of which a sound signal having a volume of up to 140 dB may be generated. In particular, the sound signal may have a volume in the range of 125 to 140 db. According to an embodiment, at least one actuating element 26 is provided. The actuating element 26 can be simultaneously configured as the optical warning element 23. According to an embodiment, three actuating elements 26 are provided. The actuating elements 26 can be configured to include a light source, and in particular the actuating elements 26 can simultaneously have the function of illumination and the function as an optical warning element 23.

The optical warning element 22 can include, for example, at least one light source. For example, the light source can generate white light with a luminous flux of up to 1200 lumens. In particular, the light signal may have a luminous flux in the range of 1000 to 1200 lumens. According to an embodiment, the light source can emit different light signals. For example, light signals with different luminous fluxes or light signals with different colors can be generated by means of the optical warning element 22. In particular, the optical warning element 22 can generate red light. In particular, continuous light signals or discontinuous light signals can be generated. For example, periodic light signals can be generated, in particular light signals with a constant period duration.

If the actuating element 26 is also configured as an optical warning element 23, the optical warning element 23 can also comprise a light source. According to an embodiment, the light of this light source has a luminous flux of up to 1000 lumens.

Figure 10B:
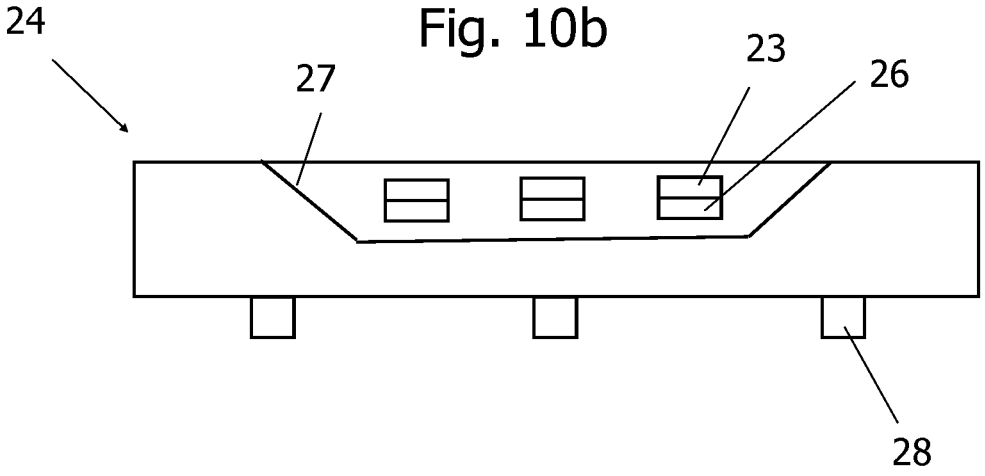

FIG. 10*b* shows a side view of the support plate element 24. In FIG. 10*b*, the actuating elements 26 are visible. According to this embodiment, each of the actuating elements 26 can also be used as an optical warning element 23. The optical warning element 23 is configured to emit light in at least two different directions. According to the embodiment shown in FIG. 10*b*, each of the actuating elements 26 is arranged in a recess 27 of the support plate element 24. By means of the recess 27, it can be ensured on the one hand that the emitted light radiates in different directions, so that the warning signal generated thereby is emitted in more than one spatial direction. Thus, the warning signal is visible from several directions and cannot simply be covered.

The actuating elements 26 in the arrangement shown in FIG. 10*b* are also easier to locate, in particular easier to feel in the dark, since the recess 27 can be easily felt with the fingers.

The support plate element 24 also includes at least one connecting element 28 for attachment in a receiving element 21, as shown in FIG. 9. The connecting element 28 can be configured as a pin element, for example. In FIG. 10*b*, three pin elements are shown as an example.

Figure 11A:
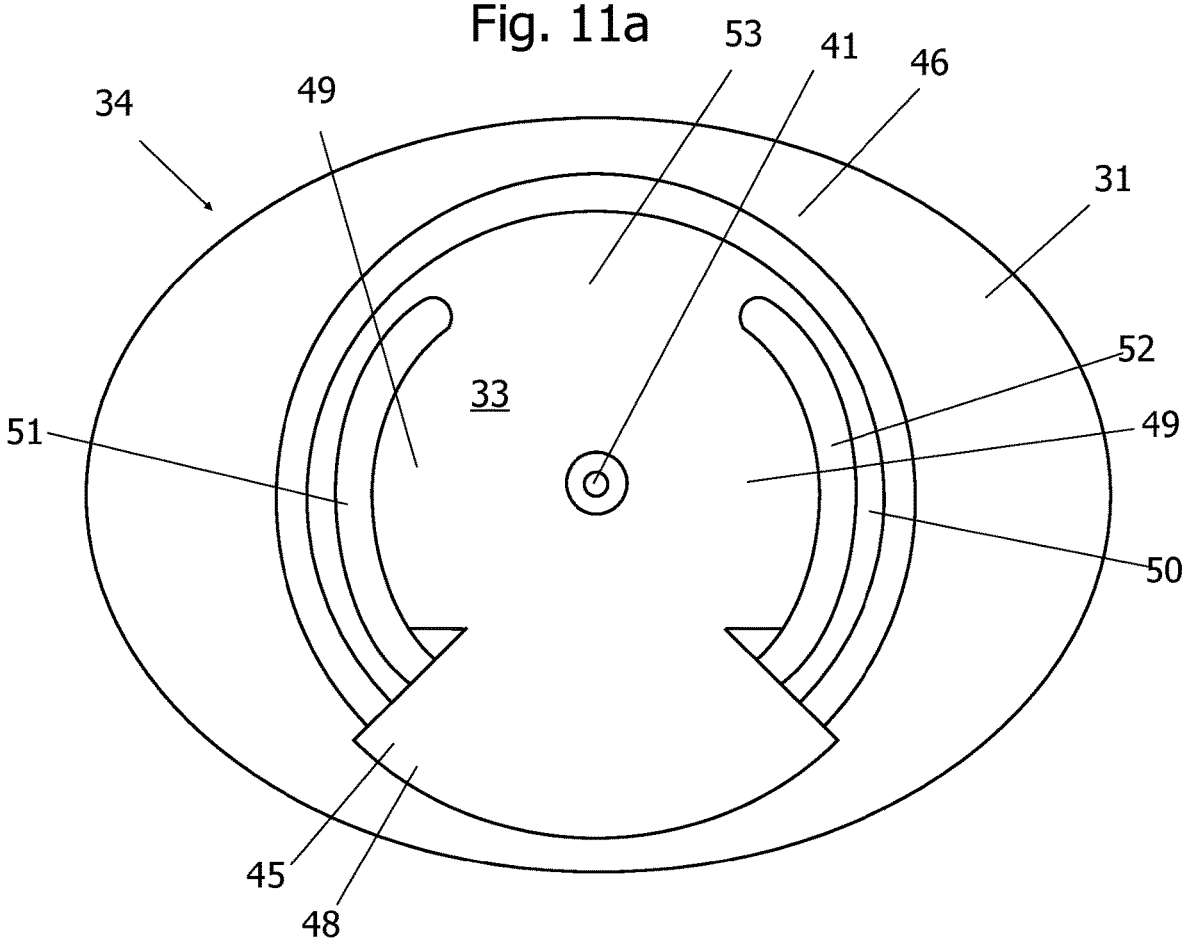
FIG. 11*c* a detail of the actuator of the support plate element according to FIG. 11*a*, FIG. 11*d* a detail of the metering device of the support plate element according to FIG. 11*a*, FIG. 11*e* a detail of the pressure vessel of the support plate element according to FIG. 11*a*, FIG. 11*f* a further top view of the support plate element according to FIG. 11*a*, FIG. 11*g* a partial section through the support plate element according to FIG. 11*a*.

FIG. 11*a* shows a third variant of a support plate element 34 that includes a pressure vessel 31 for containing a fluid, particularly a liquid. The fluid can comprise an identification means or a repellent means. For example, the fluid can include a dye usable for the purpose of identification. Alternatively or additionally, the fluid can comprise a repellent. In particular, the pressure vessel 31 can comprise a fluid by means of which irritation of the skin may be induced. For example, the fluid can include a pepper spray. The support plate element 34 is shown in a top view. The pressure vessel 31 is closed by a non-visible metering device 32 (see FIG. 11*b*, FIG. 11*d*, FIG. 11*g*) when the support plate element 34 is not in use. The metering device can be activated by means of an actuator 33. The actuator 33 includes an activation element 45, which is intended for activating the support plate element 34.

Figure 11B:
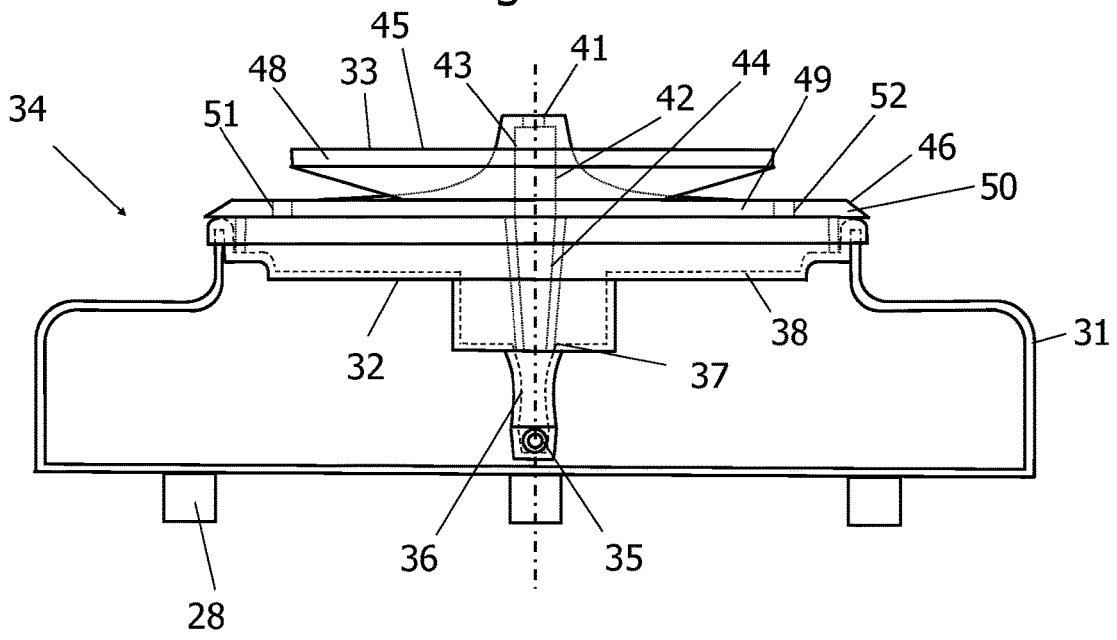

FIG. 11*b* shows a side view of the support plate element 34, wherein the pressure vessel 31 of support plate element 34 is shown in section to reveal the components within the pressure vessel 31. According to this embodiment, the support plate element 34 comprises a pressure vessel 31 shown in sectional view in FIG. 11*b*. In the operating state, the pressure vessel 31 contains a fluid. The pressure vessel 31 is closed by a metering device 32 when no fluid is to be withdrawn from the pressure vessel 31. The metering device 32 can be activated by means of an actuator 33. The pressure vessel 31 includes at least one connecting element 28 to be fastened in a receiving element 21, as shown in FIG. 9. The connecting element 28 can, for example, be configured as a pin element. In FIG. 11*b*, three pin elements are shown as an example.

Figure 11C:
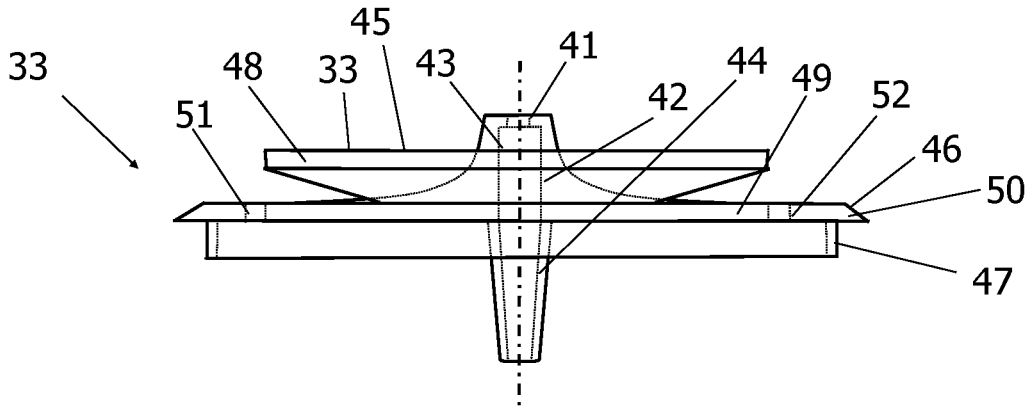
Figure 11D:
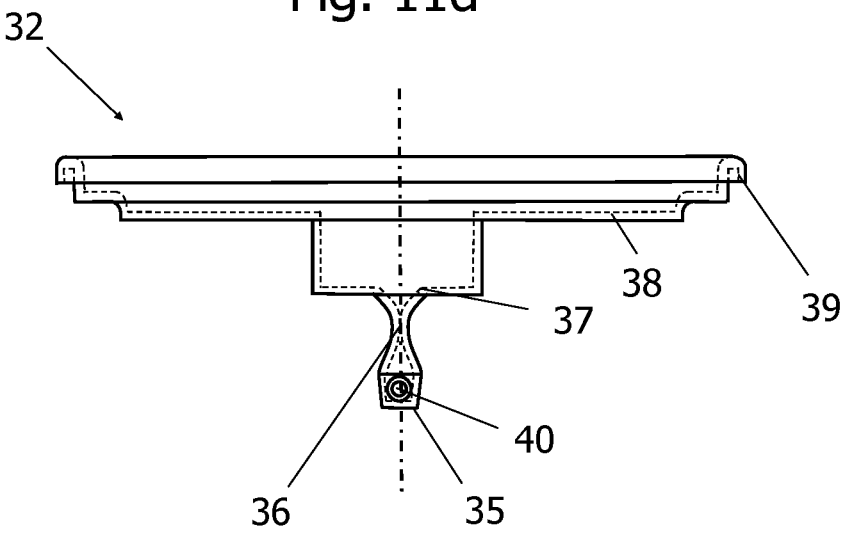
Figure 11E:
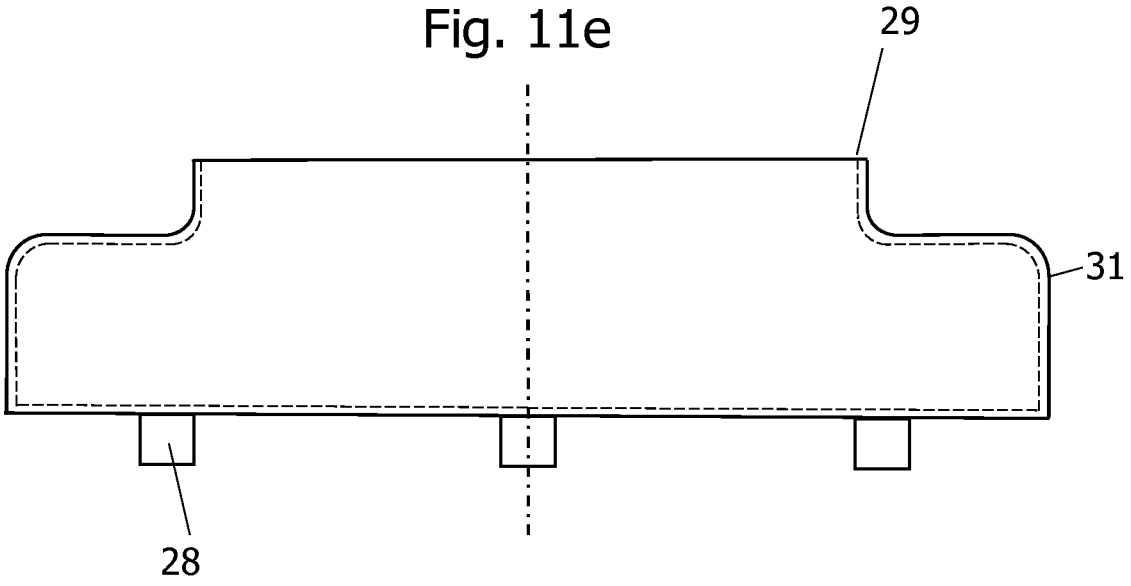
Figure 11F:
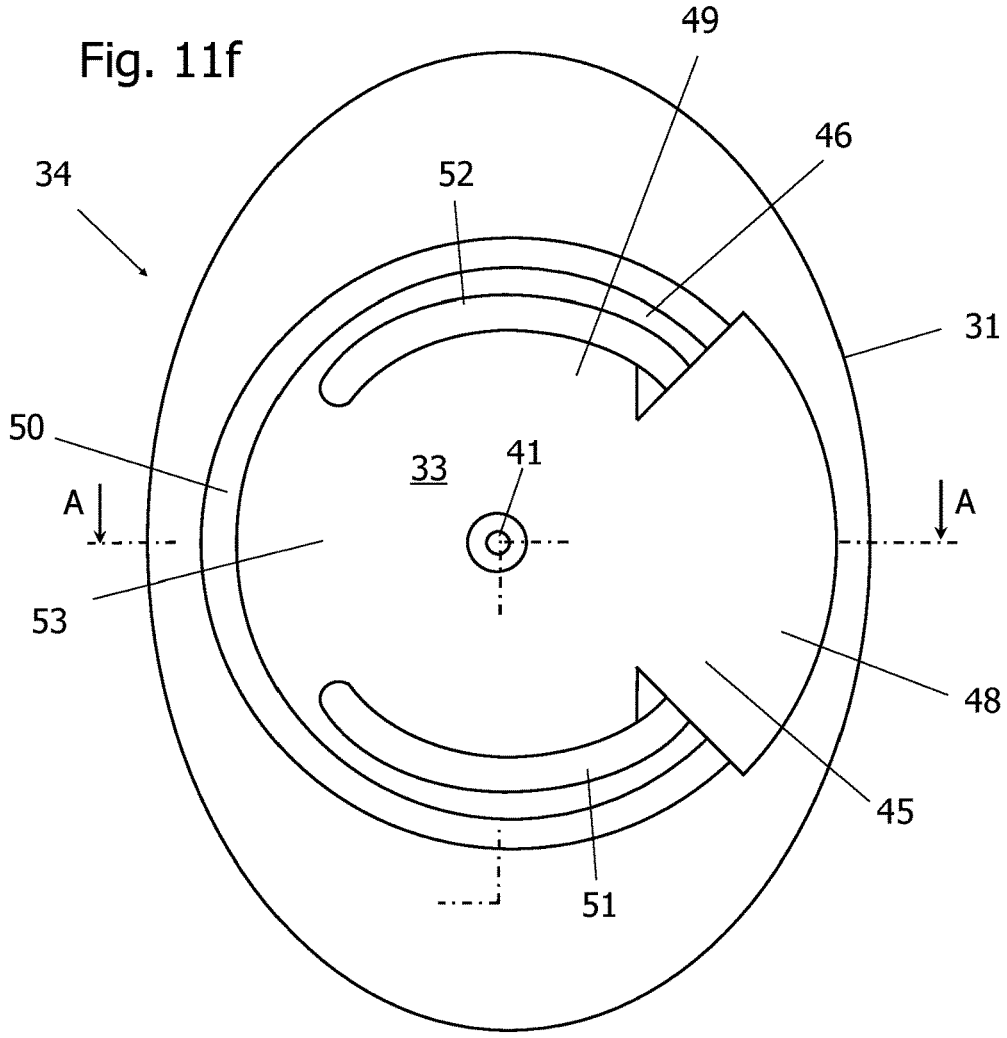
Figure 11G:
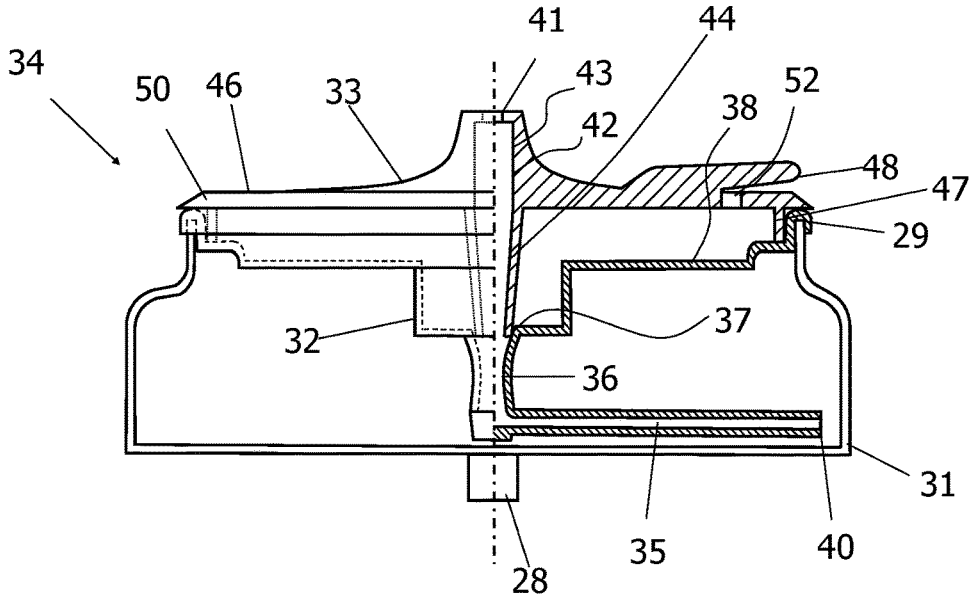

The metering device 32 includes a fluid receiving element 35, such as a tubular element, see also FIG. 11*g*, in which the tubular element is shown partially cut open. The fluid receiving element 35 is characterized by a constriction 36 that is fluid impermeable when the metering device 32 is not in use. The constriction 36 may be formed, for example, as a bottleneck. At the constriction 36, the cross-sectional area of a fluid channel extending in the fluid receiving element 35 is zero when the metering device 32 is not in operation as shown in FIG. 11*d*. Downstream of the constriction 36, the fluid channel widens to form an orifice 37. This orifice 37 is located in a cover element 38, which is attached to a rim of the pressure vessel 31 in a fluid-tight manner. For example, the cover element 38 can encompass the rim 29 of the pressure vessel 31, see also FIGS. 11*d*, 11*e* and 11*g*. The orifice 37 is in particular located in the central region of the pressure vessel 31, according to the present embodiment the orifice 37 is concentric to the center axis of the pressure vessel 31.

The actuator 33 rests on the metering device 32 and is held in the cover element 38 of the metering device 32 according to the present embodiment, see in particular FIG. 11*g*. The actuator 33 includes an opening 41 which, when assembled, is aligned with the orifice 37. The opening 41 is configured for expulsion of the fluid form the pressure vessel if the actuator 33 is actuated. An actuator fluid channel 42 extends from the opening 41 to the orifice 37. According to the present embodiment, the actuator fluid channel 42 terminates in the opening 41. A cylindrical channel section 43 adjoins the opening 41, and a conical channel section 44 adjoins the cylindrical channel section 43. The free end of the conical channel section 44 rests on the cover element 38 of the metering device 32 in the orifice 37.

The actuator fluid channel 42 is arranged in a lid element 46 of the actuator 33. The lid element 46 has a retaining device 47 on its periphery, by means of which the lid element 46 can be retained on the metering device 32. The retaining device 47 may comprise, for example, a bayonet connection, a screw connection or a snap-in connection.

According to the present embodiment, the activation element 45 is formed as a part of the lid element 46. The activation element 45 comprises a grip element 48 and an inner element 49 containing the actuator fluid channel 42, which is partially separated from an outer portion 50 of the lid element 46 by two slot sections 51, 52. The slot sections 51, 52 are arranged in a kidney shape around the inner element 49 according to an exemplary configuration, see FIG. 11*a* or FIG. 11*f*.

When the actuator 33 is actuated to withdraw fluid from the pressure vessel 31, a compressive force is applied to the grip element 48 of the activation element 45. Since the outer portion 50 and the inner element 49 are connected via a bridge piece 53 located between the two slot sections, a pivotal movement of the activation element 45 takes place relative to the outer portion 50, which is configured as a fixed clamping at the rim 29 of the pressure vessel 31 and the metering device 32 via the retaining device 47.

The rotational movement of the activation element 45 forces the cylindrical channel section containing the actuator fluid channel 42 and the conical channel section into the orifice 37. This expands the cross-section of the orifice 37 and thus the cross-section at the constriction 36, allowing the fluid in the pressure vessel 31 to pass through the constriction 36, enter the actuator fluid channel 42 and exit through the opening 41. If necessary, the opening 41 can include a nozzle such that a jet of fluid is formed that can exit the support plate element 34 at a high velocity.

FIG. 11*c* shows a detail of the actuator 33 of the support plate element 34 shown in FIG. 11*a*. As described above, the conical channel section 44 is intended to be received in the orifice 37 shown in FIG. 11*d*. When the channel section is configured as a conical channel section 44, the penetration resistance is low, so that less force must be applied to the grip element 48 to activate the support plate element 34 configured as a fluid dispenser than for a cylindrical channel section. A cylindrical channel section may alternatively be provided but is not shown in the drawings.

FIG. 11*d* shows a detail of the metering device 32 of the support plate element 34 shown in FIG. 11*a*. The metering device 32 includes a cover element 38 and a fluid receiving element 35. The fluid receiving element 35 is configured to form a fluid channel when the support plate element 34 is in the operating state. The support plate element 34 is in the operating state when a user actuates the grip element 48 of the actuator 33, see FIG. 11*b*, FIG. 11*c*, and FIG. 11*g*. In particular, the grip element 48 may be actuated by a finger of the hand on which the hand-operated self-defense device 20 is carried. In FIG. 11*d*, the non-operating state is shown so that the fluid channel is closed. According to the present embodiment, the fluid receiving element 35 comprises a tubular element which includes a fluid inlet opening 40 which, in the installed state, is arranged in the vicinity of the vessel bottom of the pressure vessel 31. The fluid channel extends through the fluid receiving element 35 from the fluid inlet opening 40 to the orifice 37. In the non-operating state, the fluid channel is closed by a constriction 36 arranged between the fluid inlet opening 40 and the orifice 37.

FIG. 11*e* shows a detail of the pressure vessel 31 of the support plate element 34 according to FIG. 11*a*. The pressure vessel 31 is intended to receive a fluid and, after being filled with the fluid, is closed in a fluid-tight manner by the metering device 32. For example, the rim 29 of the metering device can be fluid-tightly enclosed by a rim receiving element 39 of the metering device. If the pressure vessel is intended for single use, the rim receiving element 39 may be bonded or welded to the rim 29. If the pressure vessel 31 is to be configured to be refillable after use, a sealing element can be included in the rim receiving element, by means of which the escape of the fluid over the rim 29 can be prevented. This variant is not shown in the drawing.

FIG. 11*f* shows another top view of the support plate element 34 according to FIG. 11*a*. The support plate element 34 shown in FIG. 11*f* is obtained by rotating FIG. 11*a* by 90 degrees and serves to illustrate the cutting path for the sectional view of FIG. 11*g*.

FIG. 11*g* shows a partial section through the support plate element 34 according to FIG. 11*f*, wherein the pressure vessel 31 of the support plate element 34 is shown in section to provide a view of the components located inside the pressure vessel 31. In addition, the support plate element 34 is shown in a sectional view in the right half of FIG. 11*g* to show the course of the fluid channels extending in the metering device 32 and the actuator 33, which provide an exit path for the fluid contained in the pressure vessel 31 in the operating condition. The course of the section is shown in FIG. 11*f* by the letters A-A and dash-dotted lines. The fluid exit path thus includes the fluid receiving element 35, which includes a fluid channel extending from a fluid inlet opening 40 to the orifice 37 in the metering device 32 and includes the constriction 36. The fluid exit path is not provided until the actuator 33 is actuated in the operating condition. The fluid can flow through the actuator fluid channel 42 in the operating condition, which extends from the end of the conical channel section 44 of the actuator 33 located in the mouth opening 37 to the opening 41 thereof.

It is obvious to a person skilled in the art that many further variants are possible in addition to the described embodiments without deviating from the inventive concept. The subject-matter of the invention is thus not limited by the preceding description and is determined by the scope of protection defined by the claims. For the interpretation of the claims or the description, the broadest possible reading of the claims is decisive. In particular, the terms "comprising" or "including" are intended to be interpreted as referring to elements, components, or steps in a non-exclusive meaning, thereby indicating that the elements, components, or steps can be present or used, that they can be combined with other elements, components or steps that are not explicitly mentioned. When the claims refer to an element or component from a group that can consist of A, B, C through N elements or components, this phrase is intended to be interpreted as requiring only a single element of that group, and not a combination of A and N, B and N, or any other combination of two or more elements or components of that group.

What is claimed is:

1. A hand-operated self-defense device comprising a first strap element for attachment to a palm of a hand, a second strap element for attachment to a wrist of the hand, further comprising a connecting element for connecting the first strap element to the second strap element, and a defense element connected to the connecting element or the first strap element wherein the defense element includes at least one support plate element wherein the at least one support plate element includes a plurality of tip elements arranged on the at least one support plate element so as to span a surface, wherein the at least one support plate element is arranged on the connecting element in such a way that it is configured to rest on the palm of the hand, wherein the defense element includes an evidence collection device, and wherein the evidence collection device includes an adhesive.

2. The hand-operated self-defense device of claim 1, wherein the plurality of tip elements are arranged in an annular configuration on the at least one support plate element.

3. The hand-operated self-defense device of claim 1, wherein at least one of the plurality of tip elements includes an opening.

4. The hand-operated self-defense device of claim 1, wherein at least one of the first strap element or the second strap element is adjustable.

5. The hand-operated self-defense device of claim 1, wherein the evidence collection device is formed by at least one of the plurality of tip elements.

6. The hand-operated self-defense device of claim 1, wherein at least one of the first strap element or the second strap element includes a flexible material configured to conform to a shape of a hand of a wearer.

7. The hand-operated self-defense device of claim 1, wherein at least one of the first strap element or the second strap element includes a textile material.

8. The hand-operated self-defense device of claim 1, wherein the second strap element includes a closure mechanism for securing the hand-operated self-defense device to the wrist.

* * * * *